United States Patent [19]

Draper

[11] 4,149,229

[45] Apr. 10, 1979

[54] LAMP REFLECTOR WITH DOWNWARDLY-FACING STEP

[75] Inventor: Geoffrey R. Draper, Lichfield, England

[73] Assignee: Lucas Industries Limited, Birmingham, England

[21] Appl. No.: 802,834

[22] Filed: Jun. 2, 1977

[30] Foreign Application Priority Data

Jun. 18, 1976 [GB] United Kingdom ..... 25310/76
Apr. 29, 1977 [GB] United Kingdom ..... 17990/77

[51] Int. Cl.[2] ..... F21V 7/00
[52] U.S. Cl. ..... 362/349; 362/297; 362/346
[58] Field of Search ..... 362/297, 346, 349

[56] References Cited

U.S. PATENT DOCUMENTS

| | | | |
|---|---|---|---|
| 1,702,746 | 2/1929 | Prichard | 362/349 X |
| 1,995,012 | 3/1935 | Rivier | 362/346 X |
| 3,688,149 | 8/1972 | Pitkjaan | 362/346 X |
| 3,754,132 | 8/1973 | Mamrud et al. | 362/346 |

FOREIGN PATENT DOCUMENTS

| | | | |
|---|---|---|---|
| 698,928 | 11/1930 | France | 362/346 |

*Primary Examiner*—Peter A. Nelson
*Attorney, Agent, or Firm*—Ladas, Parry, Von Gehr, Goldsmith & Deschamps

[57] ABSTRACT

A lamp assembly has a reflector body formed of an injection moulded, low profile, thermoset polyester moulding composition with an integral sleeve having a stop internally of the body. A tubular bulbholder has an external flange engaging against the stop and carries a bulb. The reflector body has upper and lower paraboloidal portions of different focal length joined together by a step facing the lower paraboloidal portion. The step decreases in width inwardly from the periphery of the reflector body. The lower paraboloidal portion has a greater focal length than the upper paraboloidal portion which projects forwardly away from the rear of the reflector body to a greater extent than the lower paraboloidal portion. A mounting flange around the reflector body has a planar surface against which a lens element engages. The mounting flange is disposed between shield and the rear of the reflector body.

24 Claims, 8 Drawing Figures

LAMP REFLECTOR WITH DOWNWARDLY-FACING STEP

Figure 1:
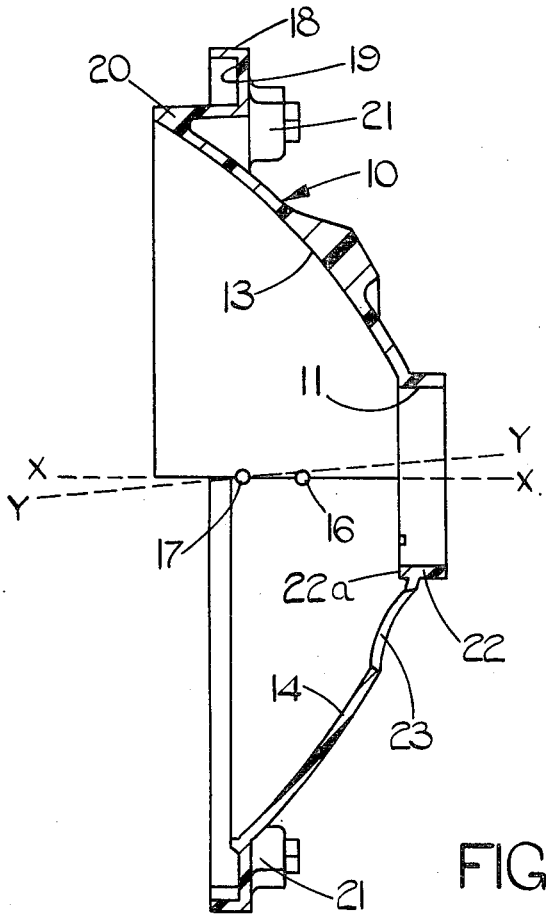

This invention relates to a lamp reflector and is particularly, though not exclusively concerned with a lamp reflector for use in a dipped headlamp for a road vehicle.

According to one aspect of the present invention, there is provided a lamp reflector having upper and lower reflective portions of different focal length joined together by a step which defines a cut-off to a beam of light emanating from the reflector in use, the lower reflective portion having a greater focal length than the upper reflective portion, the step facing the lower reflective portion and decreasing in width inwardly from the periphery of the reflective surface, the upper reflective portion projecting forwardly away from the rear of the reflector to a greater extent than the lower reflective portion so as to define a shield having a reflective surface.

The provision of the shield serves to increase the light collecting area of the upper reflective portion and reduce the risk of stray, upwardly directed beams of light escaping for the reflector. Furthermore, the shield also serves to mask an upper portion of a surrounding rim of the lens element, when fitted, so further reducing the risk of spurious reflections from a lamp assembly fitted with such a reflector.

In a preferred embodiment, the lamp reflector is provided with a mounting flange having a planar surface against which a rim of light transmitting cover element engages in use, the shield being disposed on the opposite side of the flange to the rear of the reflector.

In one embodiment, one or each of the upper and lower reflective portions lies on the surface of a paraboloid i.e. a shape reduced by rotating a parabola about its focal axis.

In another embodiment, one or each of the upper and lower reflective portions lies on a surface defined by rotating a curve lying on a non-circular conic section having a focus, about an axis which passes through the focus and which is inclined at an acute angle to the focal axis of the curve.

The curve may lie on a parabola although it preferably lies on an ellipse. In the case of an ellipse, the relevant reflective surface has a plurality of outer foci lying on a circular curve. It is found that, with this type of reflective surface, and particularly in the case where the curve lies on an ellipse, an image arrangement is projected which can be more readily lensed to produce the so-called z-beam pattern than can a reflector wherein said upper and lower reflective portions are of paraboloidal form. This is because a sharper edge is defined centrally of the beam.

In the case where only one of the upper and lower reflective portions lies on said surface, it is preferred that it is the upper reflective portion.

In the case where the curve lies on an ellipse, the lamp filament is preferably mounted with its rear or inner end disposed on the inner focus of the upper reflective portion.

In the case where the curve lies on a parabola, the lamp filament is preferably mounted with its rear or inner end forward of the focus of the upper reflective portion.

Typically, the axis of rotation of said curve is inclined at an angle of 1 to 5 degrees, preferably about 2 degrees, with respect to the focal axis of the curve.

For a more detailed description of a preferred form for the upper and/or lower reflective surface, attention is drawn to co-pending British Patent application No. 17989/77 filed on Apr. 29, 1977, the contents of which are incorporated herein by reference.

The focal axes of the upper and lower reflective portions may be coincident but it is preferred to arrange for the focal axis of the lower reflective portion to be inclined downwardly relative to the focal axis of the upper reflective portion. The preferred angle of downward tilt is ½°. This feature is particularly applicable to the embodiment wherein the upper and lower portions are paraboloidal. The downward inclination of the focal axis of the lower reflective portion gives a greater tolerance during manufacture to errors in the location of the focal axis. This downward inclination of the focal axis can be compensated for, if desired, by suitably designing the lensing on a lens element covering the face of the lamp reflector in use.

The step may be defined by two mutually inclined step portions disposed on opposite sides of a vertical plane passing through a location at which a lamp filament is intended to be located.

The step portions may be inclined at respective angles in the range of substantially 0°–20° on either or both sides, most preferably 15° and 0° respectively, relative to a horizontal plane passing through said location at which the lamp filament is intended to be located.

The terms "upper", "lower", "horizontal" and "vertical" refer to the dispositions of the various parts of the lamp reflector when the latter is in its intended orientation for use.

The provision of a lamp reflector with a downwardly facing step between the upper and lower reflective portions has the advantage that, when the lamp reflector is in use, reflections from the step will be projected downwardly rather than upwardly. It will be appreciated that this is a particular advantage where the lamp reflector is used in a dipped headlamp unit.

The provision of a step which decreases in width inwardly from the periphery of the lamp reflector has the advantage that, at the centre of the reflector, the step width will be at a minimum thereby facilitating the mounting of a bulb in the reflector. It will be appreciated that a large step at the centre of the reflector makes it more difficult to provide a suitable form of bulbholder for the bulb.

In a combination of lamp reflector of the present invention and lamp filament, it is preferred to dispose the lamp filament behind the focal point of the lower paraboloidal portion but in front of the focal point of the upper paraboloidal portion in the case where the lamp unit is a dipped headlamp unit. However, it is within the scope of the present invention to mount the filament at any other desired location in order to intensify certain portions of the beam of light projected by the light unit in use. The beam of light emanating from a lamp reflector according to the present invention can be modified also by suitable lensing provided on the light transmitting cover element.

The provision of an upper reflective portion having a shorter focal length enables maximum light collection from the filament in use; a small image at the periphery of the reflector which in turn gives a high light intensity which is highly desirable; and a large image at the apex of the dished portion. The longer focal length of the lower reflective portion has the advantage of giving a favourable image size (small, intense images) for providing a relatively intense portion, or hot spot, in the beam.

It is, of course, within the scope of the present invention to provide the lamp reflector of the present invention with reflective surfaces in addition to the aforementioned upper and lower reflective surfaces in order to enhance or change certain portions of the beam pattern projected by the lamp reflector in use.

According to another aspect of the present invention, there is provided a lamp assembly comprising an injection moulded plastics reflector body, and a bulbholder, the reflector body having a dished internal reflective surface and including a sleeve at the rear thereof, and the bulbholder being mounted in the sleeve with a shoulder on the bulbholder engaging against a stop disposed internally of the body.

With a previously proposed lamp assembly, the injection moulded plastics body is provided with an external abutment surface for a mounting flange on the bulb. Owing to design considerations, the injection sprue is provided on the abutment surface. Thus, with such an arrangement, an accurate and, therefore costly, machining operation has to be effected to remove the sprue and ensure correct positioning of the abutment surface relative to the reflector. The lamp assembly of the present invention obviates the need for such an accurate machining operation and ensures accurate positioning of the bulb filament because the stop for the bulbholder is formed by the same die member which forms the surface which is to be the reflective surface in the completed lamp assembly.

Figure 2:
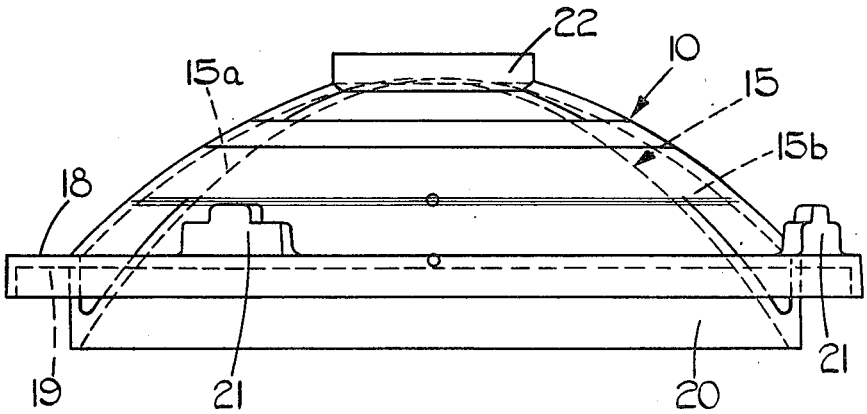
Figure 3:
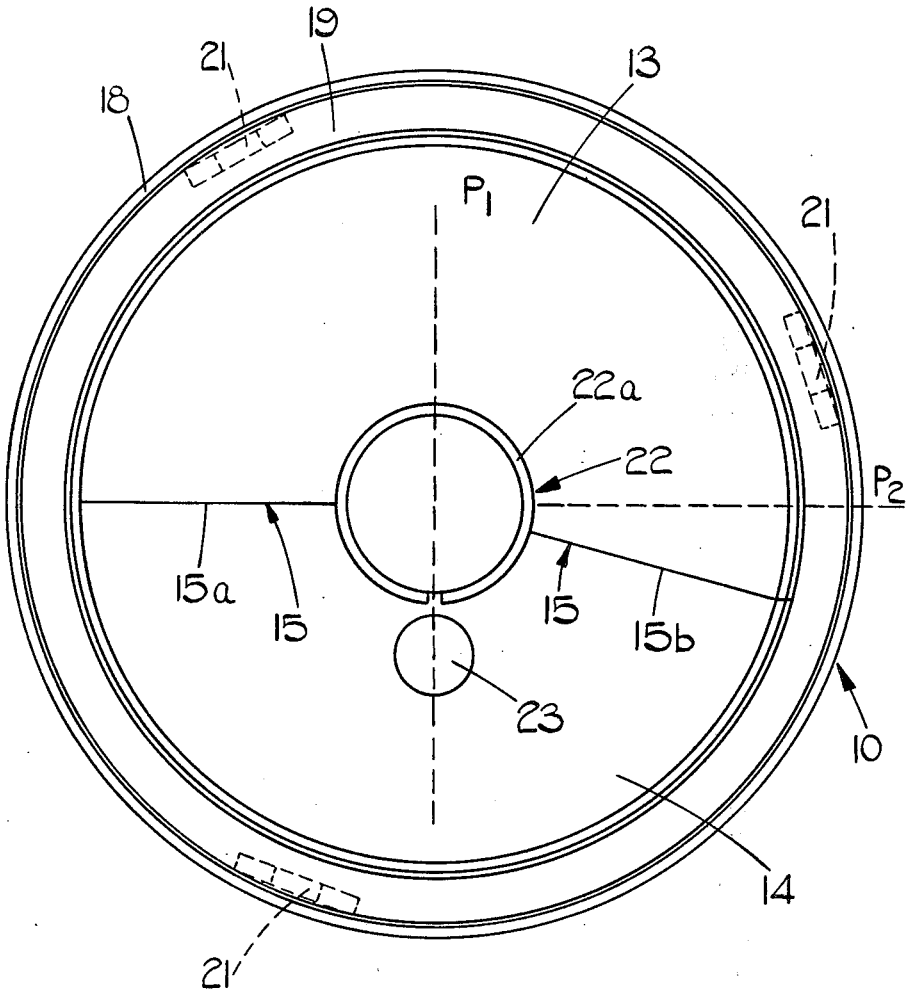
Figure 4:
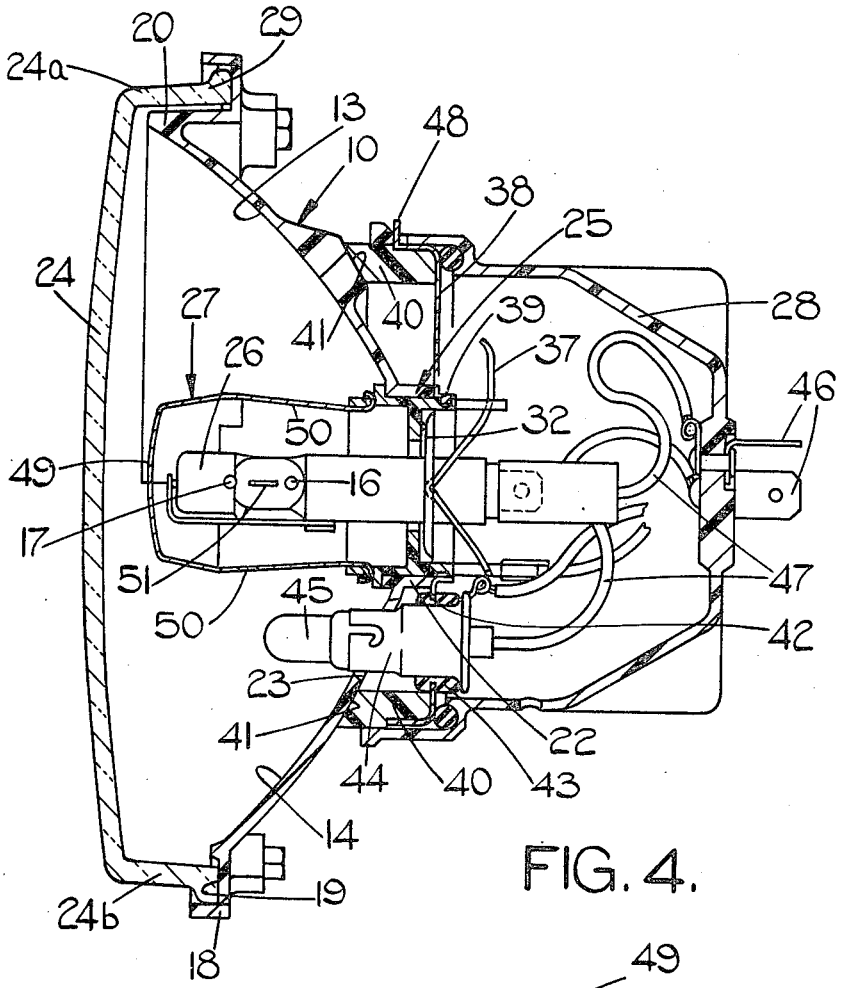
Figure 5:
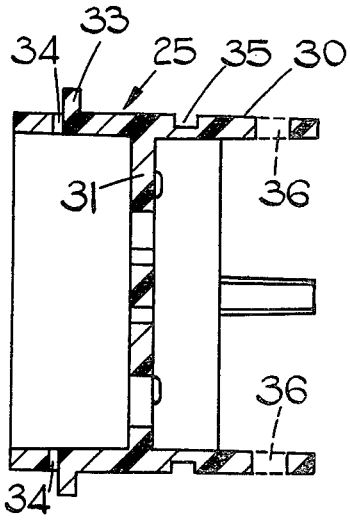
Figure 6:
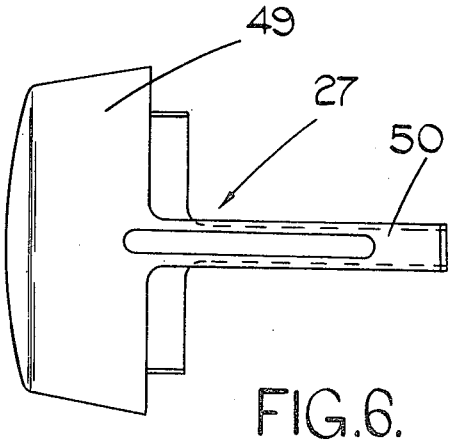
Figure 7:
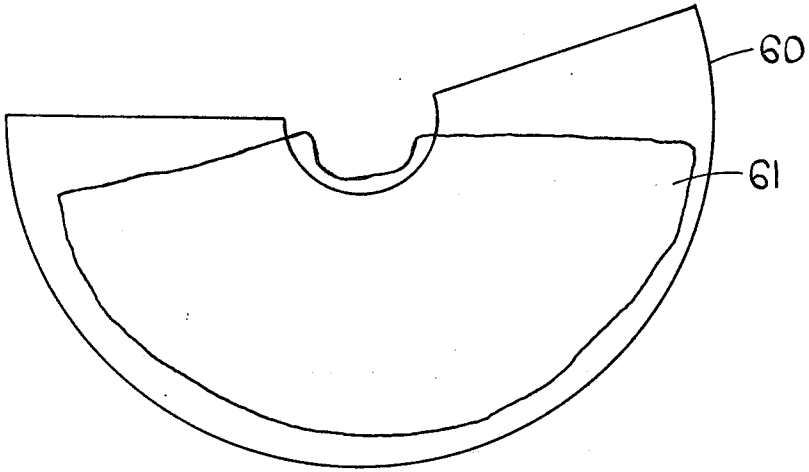
Figure 8:
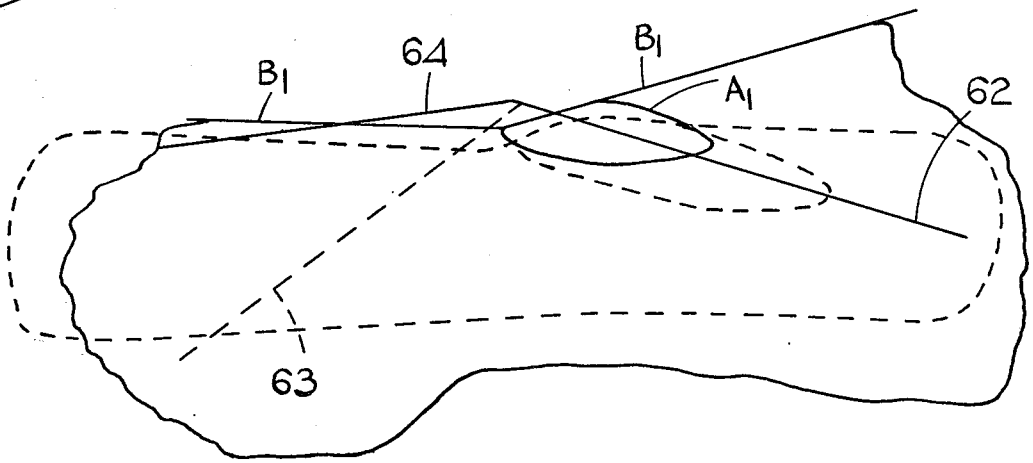

An embodiment of the present invention will now be described, by way of example, with reference to the accompanying drawings, in which:

FIG. 1 is an axial section of a lamp reflector according to the present invention, FIG. 2 is a plan view of the lamp reflector of FIG. 1, FIG. 3 is a front view of the lamp reflector of FIG. 1, FIG. 4 is an axial section of a dipped headlamp unit for a motor vehicle, incorporating the lamp reflector of FIGS. 1 to 3, FIG. 5 is an axial section of a bulbholder of the headlamp unit of FIG. 4, FIG. 6 is a plan view of a bulb shield of the headlamp unit of FIG. 4, FIG. 7 is a schematic illustration of the beam pattern of light emanating from the headlamp unit of FIG. 4 but not including a lens element, and FIG. 8 is a schematic perspective view of a beam superimposed upon a road to illustrate the light distribution of light in a beam emanating from the headlamp unit of FIG. 4 with the lens element in position.

Referring to FIGS. 1 to 3, the lamp reflector is injection moulded using a thermosetting, unsaturated polyester, low profile dough moulding composition and comprises a dished body 10 of circular form in front view and having a central, rear aperture 11 therein for receiving a bulb 12 (see FIG. 4). The body 10 is formed with an internal surface composed of an upper, paraboloidal portion 13, a lower paraboloidal portion 14, and a step 15 joining the two portions 13 and 14. The internal surface of the body 10 is subsequently lacquered and rendered reflective by means of a vacuum metallising operation followed by vacuum depositing a silicon monoxide layer to protect the vacuum metallised layer. The paraboloidal portion 13 has a focal length of 20 mm, the focal point 16 thereof being shown in FIG. 1. The lower parabolidal portion 14 has a focal length of 30 mm and the focal point 17 thereof is also shown in FIG. 1. The upper and lower parabolidal portions 13 and 14 are so mutually disposed that the step 15 faces downwardly, i.e. it faces the lower parabolidal portion 14. Also, the step 15 decreases inwardly in width (i.e. the dimension extending in the axial direction of the body 10, from the periphery of the body 10 to the central aperture 11 so that, at the central aperture 11, the width of the step 15 is minimal as can be seen from FIG. 2. This arrangement ensures that the focal point 17 of the lower paraboloidal portion 14 lies ahead of the focal point 16 of the upper paraboloidal portion 13. The body 10 is moulded so that the focal axis X—X of the paraboloidal portion 13 lies in a horizontal plane $P_2$ whilst the focal axis Y—Y of the paraboloidal portion 14 lies in a plane which is inclined at an angle of ½° relative to the horizontal plane downwardly away from the rear of the body 10 and towards the front of the body 10. However, the focal points 16 and 17 both lie on axis X—X. The body 10 is provided with an integral, surrounding mounting flange 18 which is provided with a planar abutment surface 19. The upper paraboloidal portion 13 projects forwardly away from the rear of the body 10 to a greater extent than the lower portion 14 to provide a shield 20 around the upper part of the lamp reflector. This shield 20 has, therefore, an internal surface of paraboloidal form, the surface extending on the opposite side of the flange 18 to the rear of the body 10. The flange 18 is provided with integral lugs 21 thereon to enable the lamp reflector to be mounted adjustably within a housing (not shown) as is usual with lamp reflectors for dipped headlamps for motor vehicles.

As can be seen from FIG. 2, the step 15 is formed of two mutually inclined step portions 15*a* and 15*b* disposed on either side of a vertical plane $P_1$ passing through axes X—X and Y—Y. Step portions 15*a* and 15*b* are inclined in the radial at respective angles of 0° and 15° below the horizontal plane $P_2$ passing through the centre of the reflector (see FIG. 3). The step 15 is shown in FIG. 3 as being horizontal in the axial direction of the body 19 but, in practice, it will normally be provided with a sufficient draw angle thereon to facilitate moulding of the body 10. It is preferable for optical reasons to arrange for the step to be horizontal or even have a slight negative draw angle in the axial direction of the body 10 (to minimise the risk of upward reflections from the step) and it is within the scope of the present invention to so mould the body 10, but this would require relatively complex mould tooling.

The body 10 is moulded with an integral, external sleeve 22 surrounding the aperture 11 and with a further aperture 23 therein vertically below the aperture 11.

Referring now to FIGS. 4 to 6, the headlamp unit comprises the reflector body 10, a lens element 24, a bulbholder 25, a bulb 26, a bulb shield 27, and a rear casing 28. The lens element 24 has a mounting flange 29 which engages against the planar surface 19 on the body 10 and is secured thereto by adhesive. The lens element 24 is provided with a diffraction pattern or so-called "lensing" thereon whose effect will be described hereinafter.

As can be seen in FIG. 4, the shield 20 masks an upper portion 24*a* of a rim 24*b* of the lens element 24, said rim 25*b* carrying the mounting flange 29.

The bulbholder 25 is mounted in the sleeve 22 and comprises a generally cylindrical hollow body 30 having an integral, internal, apertured partition 31 providing an abutment surface for a mounting flange 32 of the bulb 26. The body 30 is also formed, on one side of the partition 31, with an external annular shoulder 33 therearound and with a pair of diametrically opposed apertures 34 therethrough. The annular projection 33 abuts against a stop internally of the body 10 and integral therewith. In the embodiment, the stop is formed by an inwardly projecting annular end surface **22*a* of the sleeve 22. This serves, as noted hereinbefore, to enable the bulbholder 25 to be accurately positioned in the body 10. On the opposite side of the partition 31 to the projection 33 and apertures 34, the body 30 is formed with an external annular recess 35 therearound and with a mounting 36 which detachably receives a spring clip 37 engaging the flange 32 of the bulb 26. A mounting plate 38 has an internal ribbed flange 39 which is snap fitted into the recess 35. The mounting plate 38 is bonded at its outer periphery to an annular sleeve 40 sealed against and secured to a substantially frusto-conical surface 41 on the body 10. In this manner, the bulbholder 25 and thus the bulb 26 is held accurately and securely relative to the body 10 with a good seal being provided between the mounting plate 38 and the frusto-conical surface 41**.

The mounting plate 38 has an aperture 42 therethrough which is aligned with the aperture 23 in the body 10. A grommet 43 secured in the aperture holds a further bulbholder 44 in which a small side light bulb 45 is mounted to project through the aperture 23 in the body 10. The casing 28 carries electrical supply terminals 46 electrically connected by wiring 47 to light bulbs 26 and 45. The casing 28 is engaged, in bayonet fashion, with projections 48 on the mounting plate 38 and over the sleeve 40.

The bulb shield 27 comprises a cup-shaped end 49 providing a so-called "uplight" shield and a pair of upper and lower mounting legs 50 which are engaged in the apertures 34 of the bulbholder 25 so that the bulb shield 27 is supported by the bulbholder 25.

In use, the bulb 26 is mounted so that a filament 51 therein lies with its axis just above axis X—X so that the lowermost part of the filament lies on axis X—X. The filament 51 is disposed in front of focal point 16 but behind focal point 17.

Because the filament 51 is disposed between the two focal points 16 and 17, light emanating from the filament 51 and reflected from both portions 13 and 14 will be reflected downwardly as will be apparent to any person skilled in the art. The light beam pattern emanating from the lamp reflector described above, without the effect of the lens element 24 being shown, is illustrated in FIG. 7. Area 60 of the light beam is provided as a result of reflection from the upper paraboloidal surface 13 whilst area 61 represents that due to the provision of the lower parabolic portion 14. The angled cut-off illustrated in FIG. 7 is, of course, appropriate to a headlamp used in a motor vehicle driven on the right hand side of the road. In a standard, single paraboloidal reflector, only the area 60 is projected, the remaining area being shielded off because it is not disposed in the same place as area 61 but is disposed above area 60 and thus leads to dazzling of other road users. Thus, the beam projected by a lamp reflector according to the present invention provides a much greater intensity of light over a portion of the beam than is provided by the beam projected by a conventional, single parabolic reflector. In order to enhance further the illumination of certain desired areas of the beam, the lens element 24 has suitably designed lensing thereon such as to produce the desired concentration of illumination of the nearside kerb of the road. In FIG. 8, the nearside kerb is illustrated by line 62, the centre of the road by dotted line 63 and the offside kerb by line 64. The upper cut-off of the beam projected by the upper paraboloidal portion 13 is illustrated by line $B_1$. The cut-off line $B_1$ is sharply defined because, due to the provision of the downwardly facing step 15, this line is defined by the front edge of the step rather than by the rear edge of the step as is the case when the step faces upwardly. The front edge can be moulded more sharply than the rear edge and is less likely to become obscured by previously described coating layers applied to the internal surface of the body.

A high intensity portion of the light beam emanating from the portion 13 is illustrated by the enclosed area $A_1$ and is produced by the lensing on the lens element 24. The corresponding pattern projected by the lower paraboloidal portion 14 is illustrated in dotted line in FIG. 8. The longer focal length of the lower paraboloidal portion 14 gives smaller intenser images of the filament than that given by the shorter focal length of the upper paraboloidal portion 13. Thus, the lower paraboloidal portion 14 provides images which can be readily aimed to give a "hot-spot" at the required position and of the required intensity in the light beam pattern, whilst the upper paraboloidal portion 13 ensures maximum light collection from the filaments 51 to give a good overall illumination within the whole area of the beam. The fact that the step 15 faces downwardly, i.e. towards the lower paraboloidal portion 14, means that any spurious reflections of filament images from the envelope of the bulb 12 which reach the step 15 will be further reflected downwardly within the existing beam pattern rather than being reflected upwardly out of the existing beam pattern which would be the case if the step 15 faced upwardly. If desired, the bulb shield 27 can be completely dispensed with.

The lower paraboloidal portion 14 is expected to boost wide angle and road surface illumination by a factor of 50–100% and 50% respectively. It is also expected to increase by 20–30% the intensity of the "hot-spot" compared with the case of a single paraboloidal reflector where, effectively, only half of the paraboloidal reflector is used.

I claim:

1. A lamp reflector comprising upper and lower portions having respective reflective surfaces of different focal length joined together by a step which defines a cut-off to a beam of light emanating from the reflector in use, the lower reflective surface having a greater focal length than the upper reflective surface, the step facing the lower reflective surface and decreasing in width inwardly from the periphery of the reflector, the upper portion and the reflective surface thereof projecting forwardly away from the rear of the reflector to a greater extent than the lower portion and the reflective surface thereof so as to define a reflective shield.

2. A lamp reflector as claimed in claim 1, provided with a mounting flange having a planar surface against which a rim of a light transmitting cover element engages in use, the shield being disposed on the opposite side of the flange to the rear of the reflector.

3. A lamp reflector as claimed in claim 1 at least, wherein one of the upper and lower reflective surfaces lies on the surface of a paraboloid.

4. A lamp reflector as claimed in claim 1, at least, wherein one of the upper and lower reflective surfaces lies on a surface defined by rotating a curve lying on a non-circular conic section having a focus, about an axis which passes through the focus and which is inclined at an acute angle to the focal axis of the curve.

5. A lamp reflector as claimed in claim 4, wherein said curve lies on a parabola.

6. A lamp reflector as claimed in claim 4, wherein said curve lies on an ellipse so that said at least one of the upper and lower reflective surfaces has a plurality of outer foci lying on a circular curve.

7. A lamp reflector as claimed in claim 6, in combination with a lamp filament, the lamp filament being mounted with its rear end disposed on the inner focus of the upper reflective portion.

8. A lamp reflector as claimed in claim 5, in combination with a lamp filament, the lamp filament being mounted with its rear end forward of the focus of the upper reflective portion.

9. A lamp reflector as claimed in claim 4, wherein the axis of rotation of said curve is inclined at an angle of 1–5 degrees with respect to the focal axis of the curve.

10. A lamp reflector as claimed in claim 9, wherein said angle is about 2 degrees.

11. A lamp reflector as claimed in claim 1, wherein the focal axes of the upper and lower reflective portions are coincident.

12. A lamp reflector as claimed in claim 1, wherein the focal axis of the lower reflective surface is inclined downwardly relative to the focal axis of the upper reflective portion.

13. A lamp reflector as claimed in claim 12 wherein the angle of downward tilt is $\frac{1}{2}°$.

14. A lamp reflector as claimed in claim 1, wherein the step is defined by two mutually inclined step portions disposed on opposite sides of a vertical plane passing through a location at which a lamp filament is intended to be located.

15. A lamp reflector as claimed in claim 14, wherein the step portions are inclined at respective angles in the range of substantially 0°–20° on at least one side, relative to a horizontal plane passing through said location at which a lamp filament is intended to be located.

16. A lamp reflector as claimed in claim 15, wherein the step portions are inclined at 15° and 0°, respectively, relative to said horizontal plane.

17. A lamp reflector as claimed in claim 3, in combination with a lamp filament, wherein the lamp filament is disposed behind the focal point of the lower paraboloidal portion but in front of the focal point of the upper paraboloidal portion.

18. A lamp assembly comprising an injection moulded plastics reflector body, and a bulbholder, the reflector body having a dished, internal reflective surface and including a sleeve at the rear thereof, and the bulbholder being mounted in the sleeve with a shoulder on the bulbholder engaging against a stop disposed internally of the body.

19. A lamp assembly as claimed in claim 18, wherein the stop is provided by an inner end surface of the sleeve.

20. A lamp assembly as claimed in claim 18, wherein the bulbholder comprises a hollow body having an internal abutment surface for a mounting flange of a bulb, and the shoulder extends externally of the hollow body but is disposed internally of the reflector body.

21. A lamp assembly as claimed in claim 20, wherein the outer surface of the hollow body of the bulbholder has a recess therein externally of the sleeve and the reflector body and a mounting member fixed at its outer periphery relative to the reflector body has an internally ribbed flange engaging in said recess so as to hold the shoulder on the hollow body of the bulbholder against said stop.

22. A lamp assembly as claimed in claim 21, wherein the mounting member is bonded at its outer periphery to an annular sleeve, which is sealed against and secured to an external surface of the reflector body surrounding the sleeve of the latter.

23. A lamp assembly as claimed in claim 21, wherein projections at the outer periphery of the mounting member receive, in bayonet fashion, a casing which overlies the rear of the bulb, in use, and which carries supply terminals for the bulb.

24. A lamp assembly as claimed in claim 18, wherein the reflector body has upper and lower body portions having upper and lower reflective surface portions respectively of different focal length joined together by a step which defines a cut-off to a beam of light emanating from the reflector in use, the lower reflective surface portion having a greater focal length than the upper reflective surface portion, the step facing the lower reflective surface portion and decreasing in width inwardly from the periphery of the reflector, the upper body portion and the reflective surface portion thereof projecting forwardly away from the rear of the reflector to a greater extent than the lower body portion and the reflective surface portion thereof so as to define a reflective shield.

* * * * *